United States Patent [19]

Slagley et al.

[11] Patent Number: 4,723,516

[45] Date of Patent: Feb. 9, 1988

[54] VALVE OPEN DURATION AND TIMING CONTROLLER

[76] Inventors: Michael W. Slagley; M. Kathy Slagley, both of 11661 Flamingo Dr., Garden Grove, Calif. 92641

[21] Appl. No.: 801,473

[22] Filed: Nov. 25, 1985

[51] Int. Cl.[4] ..... F01L 1/10

[52] U.S. Cl. ..... 123/90.16; 123/90.39; 123/90.61

[58] Field of Search ..... 123/90.15, 90.16, 90.17, 123/90.31, 90.39, 90.41, 90.61

[56] References Cited

U.S. PATENT DOCUMENTS

| | | | |
|---|---|---|---|
| 1,395,851 | 11/1921 | McLean | 123/90.16 |
| 3,888,217 | 6/1975 | Hisserich | 123/90.15 |
| 4,187,810 | 2/1980 | Buehner | 123/90.16 |
| 4,519,345 | 5/1985 | Walter | 123/90.16 |

FOREIGN PATENT DOCUMENTS

| | | | |
|---|---|---|---|
| 209542 | 7/1957 | Australia | 123/90.16 |
| 971641 | 1/1951 | France | 123/90.16 |
| 83540 | 7/1981 | Japan | 123/90.16 |
| 16436 | of 1906 | United Kingdom | 123/90.16 |
| 775358 | 11/1980 | U.S.S.R. | 123/90.16 |

*Primary Examiner*—Ira S. Lazarus

*Attorney, Agent, or Firm*—Allen A. Dicke, Jr.

[57] ABSTRACT

The angular timing relationship of the cams opening and closing the inlet and exhaust valves of an internal combustion engine can be varied while the engine is running to improve combustion efficiency. The angular relationship is varied by shifting of idler rollers 78, 80 acting on the camshaft driving timing chain adjusted by providing two cams 108, 110 for the same valve intake 104 so that cam 108 controls opening and cam 110 controls closing. Exhaust valve 105 has its opening controlled by cam 115 and its closing controlled by cam 113. An idler 122 between the two camshafts controlling cams 110 and 115 acts on the timing chain. The timing is also varied by moving the pivot point 104 of the rocker arm 62 to obtain later closing of the inlet and earlier opening of the exhaust valve 46 at high speed. Valve timing and duration is also controlled by adjusting the length of the push rod 108 and its point of contact with rocker arm 62.

35 Claims, 7 Drawing Figures

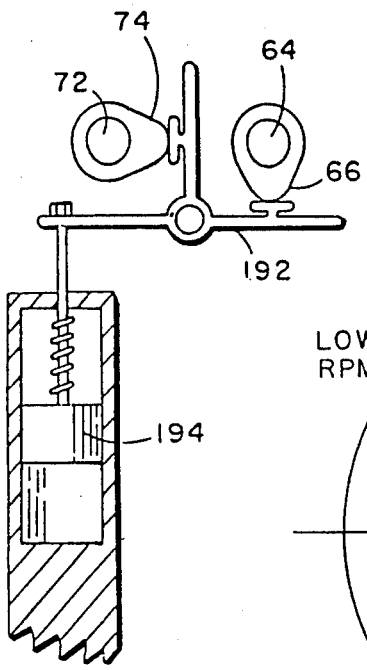
FIG. 3
FIG. 4
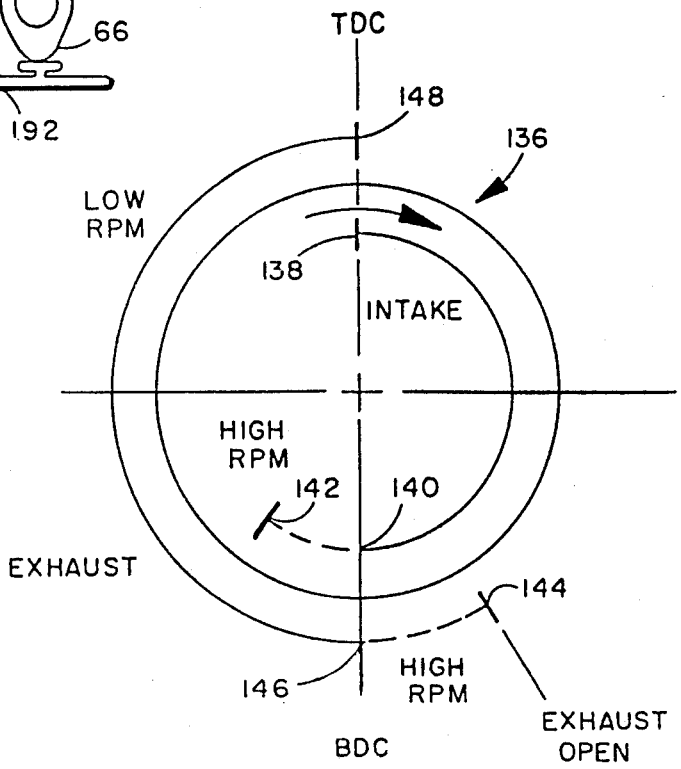
FIG. 1
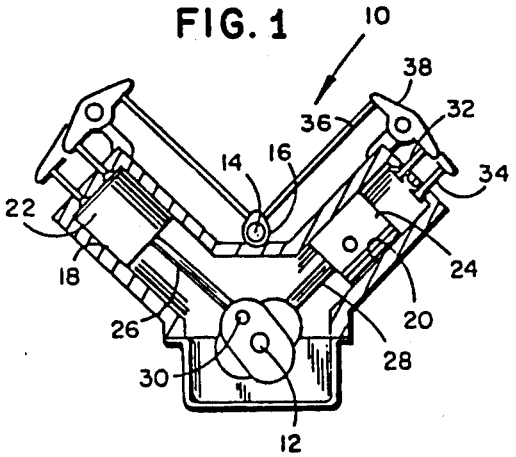

FIG. 5
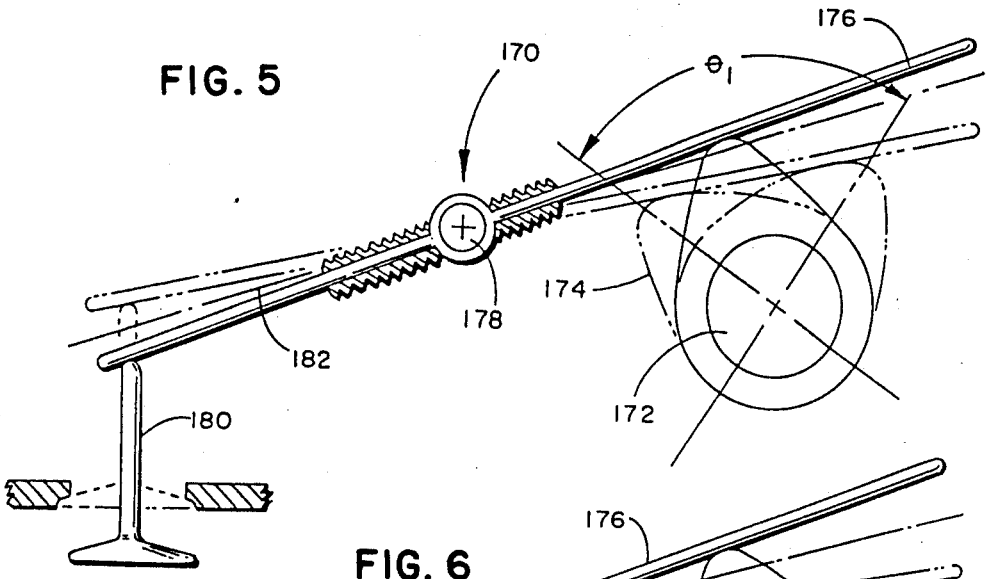
FIG. 6
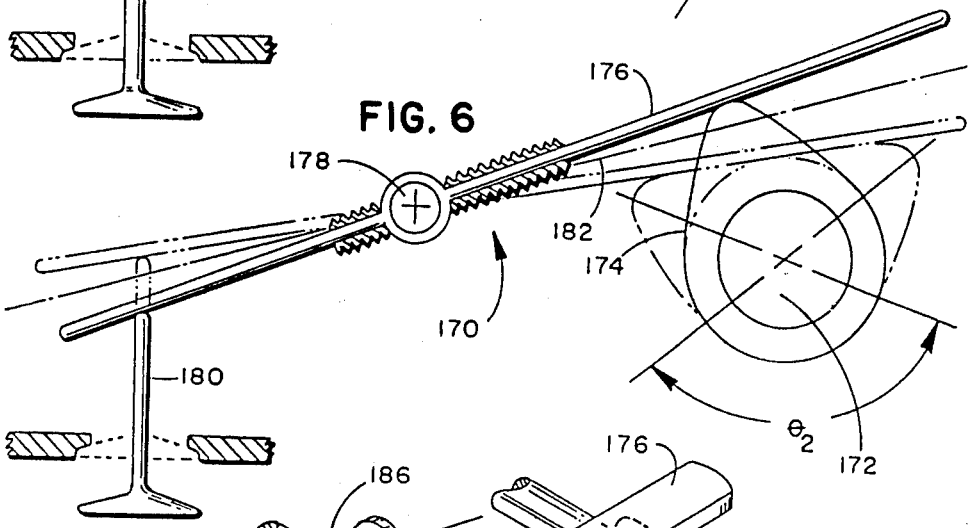
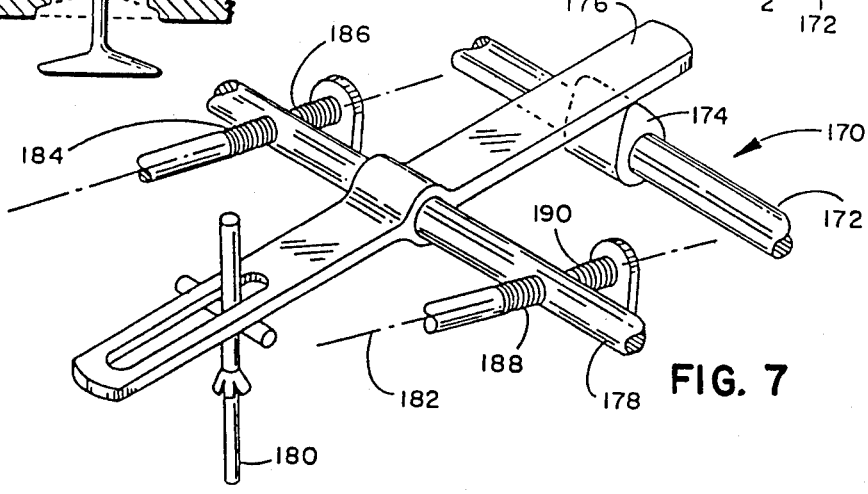
FIG. 7

VALVE OPEN DURATION AND TIMING CONTROLLER

CROSS REFERENCE

This application is related to patent application Ser. No. 231,123, filed Feb. 3, 1981, now abandoned, to patent application Ser. No. 362,953, filed Feb. 29, 1982, now abandoned, and to patent application Ser. No. 606,375, filed Mar. 8, 1984 now abandoned The disclosures of these applications are incorporated herein by this reference.

TECHNICAL FIELD

This invention is directed to a valve open duration and timing control for the valves in an internal combustion engine to improve combustion efficiency and reduce contaminants exhausted from the engine.

BACKGROUND ART

In the normal four-cycle internal combustion engine, a camshaft is driven at half the crankshaft rotational speed. Cams on the camshaft control the opening and closing of both the intake and exhaust valves. In the operation of a four-cycle internal combustion engine, if the cam timing and duration is such that the intake valve begins opening at top dead center of the intake stroke and is closed at the bottom center of the stroke and the exhaust valve begins opening at the bottom center of the exhaust stroke and is closed at the top center of the exhaust stroke, the engine would be restricted to low rpm operation and low power output. At high rotative speed (rpm) the breathing efficiency would be low. On the other hand, if the cam timing and duration allowed sufficient overlap of valve opening and closing at the beginning and end of both the intake and exhaust strokes, breathing efficiency would be greatly increased at higher rotative speed, although at very low rotative speed, efficiency would be impaired, economy reduced, and pollution increased.

No mechanical efficient mechanism exists which permits adjustment of the cam timing to control both the point of valve opening and the duration of valve opening of both sets of valves during engine operation. Such valve adjustment is necessary for optimizing engine function with varying conditions. The principal change in engine operating conditions, for which valve open duration and timing control is advantageous, is change in rotative speed, although other engine operating criteria such as load, fuel quality, air temperature and pressure and the like have a small effect on engine operating conditions and can be employed as signals for valve open duration and timing adjustment.

SUMMARY

In order to aid in the understanding of this invention, it can be stated in essentially summary form that it is directed to a valve open duration and timing controller wherein the timing relationship of valve opening is varied by shifting idlers in the valve drive system, or by changes in push rod or rocker arm geometry.

It is, thus, a purpose and advantage of this invention to provide equipment whereby the valve timing of an internal combustion engine can be controlled with respect to piston motion, principally as a function of engine rotative speed so that efficiency and combustion are optimized.

It is another purpose and advantage to provide a valve control mechanism which is convenient of construction and is easily applied to present types of internal combustion engines so that valve opening control can be readily achieved in internal combustion engines of size and style commonly in use. It is a further purpose and advantage to provide a mechanism whereby the duration of valve opening can be controlled in an economic and reliable manner hwile the engine is running.

It is a further purpose and advantage of this invention to control the valve timing of an internal combustion engine by rotating the camshaft relative to the crankshaft by means of control of the timing chain therebetween. It is a further purpose and advantage of this invention to control the valve opening and closing by employing a camshaft which rotates directly with the crankshaft and changes the rocker arm geometry to obtain different effective valve opening and closing points.

Other purposes and advantages of this invention will become apparent from a study of the following portion of the specification, the claims and the attached drawings.

BRIEF DESCRIPTION OF THE DRAWINGS

FIG. 1 is a transverse section through an internal combustion engine showing some principal mechanical parts.

FIG. 3 is a schematic diagram showing the manner in which two camshafts control the actuation of a slide valve.

FIG. 4 is a schematic timing diagram of valve operation versus crank angle.

FIG. 5 is a diagram of a further preferred embodiment of the valve open duration and timing controller in accordance with this invention in which changes in rocker arm actuation geometry causes valve operation changes, showing the mechanism in a first position of minimum valve open duration.

FIG. 6 is similar to FIG. 5, but showing the mechanism in the maximum valve open duration position.

FIG. 7 is a perspective view of the cam operating portion of the engine of FIG. 5, showing a structure in which the rocker arm can be moved.

DESCRIPTION OF THE PREFERRED EMBODIMENTS

Figure 2:
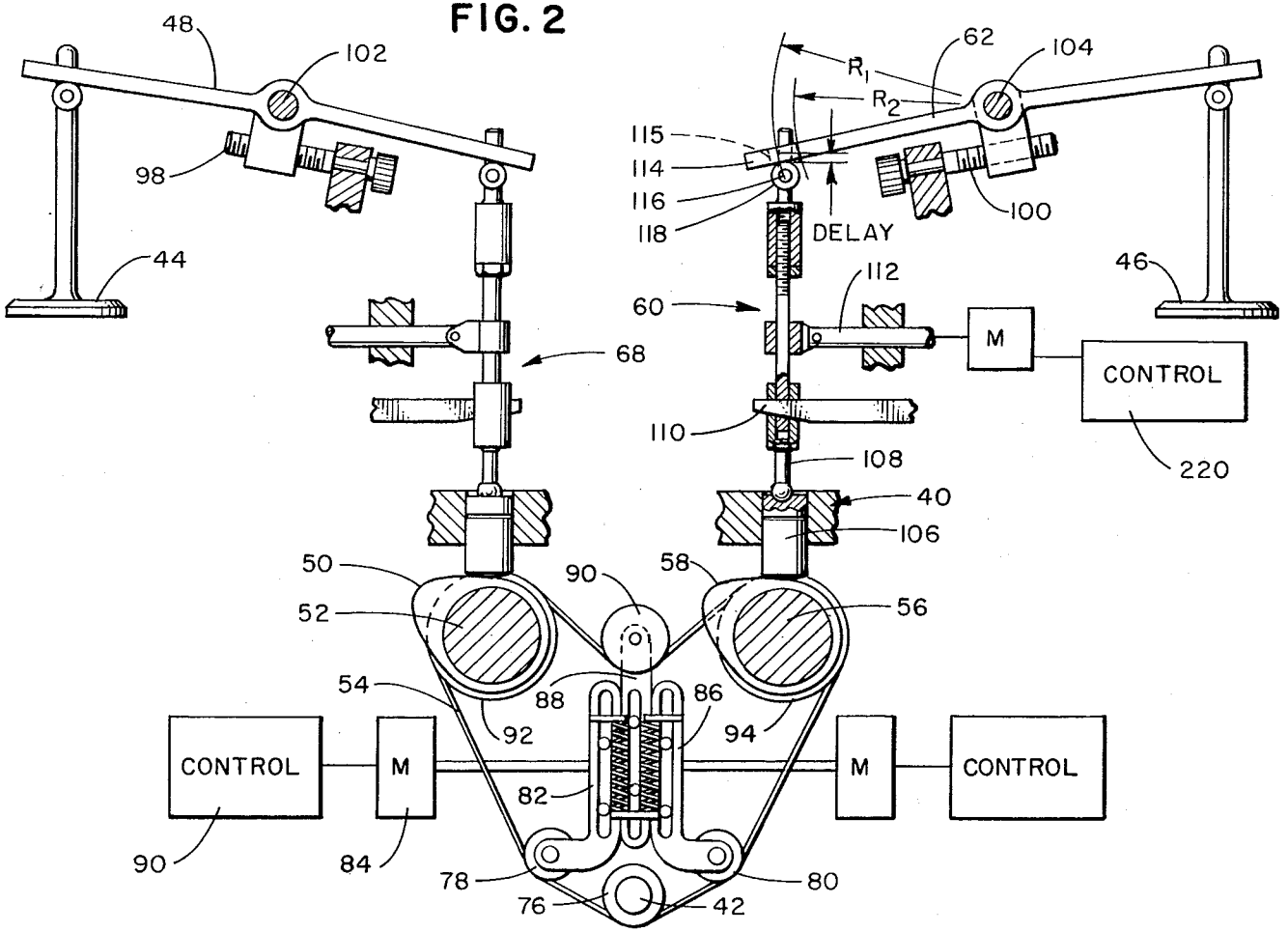
FIG. 2 is a front-elevational view of an internal combustion engine, showing a preferred embodiment of a camshaft drive mechanism whereby both the valve opening duration and the valve timing of both intake and exhaust valves are controlled.

FIG. 1 schematically illustrates an internal combustion engine 10. The internal combustion engine 10 has one or more cylinders in which reciprocate one or more pistons, respectively. The pistons are connected by connecting rods to cranks on the crankshaft so that the rotative position of the crankshaft controls the linear position of the piston in the cylinder. The first shaft 12 of engine 10 is the crankshaft or another shaft which has both its rate of rotation and its instantaneous angular position proportional to the conventional crankshaft. In other words, first shaft 12 is either the crankshaft or something rotating with the crankshaft such as a countershaft driven at crankshaft speed or half crankshaft speed and geared thereto for both angular rate and angular position relationship. Furthermore, engine 10 has a camshaft 14 therein. Camshaft 14 carries one or more cams 16 which cause the opening and the closing of valves which permit the intake of air (sometimes carrying fuel vapor) and exhaust of combustion products from the cylinder as the piston moves therein. In the conventional four-stroke cycle internal combustion engine, the intake valve is opened by such a cam for approximately the time from the piston position at top dead center to the piston positon at bottom dead center, which is controlled by crankshaft 12 and indicated by the position of the crankshaft, see FIG. 4. Such a cam 16 on the camshaft or second shaft 14 controls the opening of and the closing of the exhaust valve which in the conventional four-stroke cycle engine, is open approximately from bottom dead center of the exhaust stroke, which immediately precedes the intake stroke.

These relationships are conventional and may be mechanized in several ways, one of which is illustrated in the transverse cross-section taken through a pair of cylinders in a V-shaped engine. In FIG. 1, engine 10 has cylinders 18 and 20 arranged at an angle to each other and respectively carrying pistons 22 and 24. The position of the pistons in their cylinder is controlled by connecting rods 26 and 28, which, in turn, are controlled by one or more crankpins such as crankpin 30 on crankshaft 12.

To control the entrance of air (which may or may not contain fuel vapor therein) and to control the exit of exhaust gases, inlet and exhaust valves 32 and 34 are provided for each cylinder. These valves are each controled by a cam such as cam 16 acting through push rod 36 and rocker arm 38 to press down on the stem of inlet valve 32 to cause it to be urged open against spring force. Another cam, push rod and rocker arm control the exhaust valve 34. Similar cams, push rods and rocker aarms control each of the other intake and exhaust valves of each of the cylinders. While two cylinders are illustrated in FIG. 1, the engine 10 may have more such cylinders positioned along the axis defined by crankshaft 12.

FIG. 2 illustrates internal combustion engine 40 which is arranged so that for both intake and exhaust valves both the open time duration of the valves and the timing of the valve operation with respect to the crankshaft can be controlled. Internal combustion engine 40 is simililar to internal combustion engine 10 in that it has one or more cylinders therein, each having a position with the piston controlled by a crank on the crankshaft. Shaft 42 is either the crankshaft or a first shaft running in angular synchronism with the crankshaft so that its angular position is a direct function of the position in the cylinder. Valve 44 is one of the intake valves of the engine 40, and valve 46 is one of the exhaust valves for which the duration of valve opening is controlled. The timing of the opening of intake valve 44 and the closing of exhaust valve 46 is also controlled. Engine 40 may have a plurality of cylinders, and each has at least one intake and one exhaust valve.

Valve 44 is normally spring-urged to the closed position, and rocker arm 48 thrusts the valve in the open direction. Cam 50 is associated with rocker arm 48 so that when the cam lobe of cam 50 is directed towards the rocker arm, the rocker arm is moved in the counterclockwise direction to open valve 44 from the position shown. Cam 50 can hold the valve open. Cam 50 is fixed on camshaft 52, which is driven by shaft 42 by means of timing chain 54. Cam 50 thus opens and closes intake valve 44 at preselected points.

Camshaft 56 is also driven from timing chain 54. It carries cam 58 which operates through push rod system 60 and rocker arm 62 to actuate exhaust valve 46. The push rod system 60 is the same as push rod system 68 and will be described below. The push rod systems are integrally related to the respective rocker arms which also have valve control features in association therewith. Such are also described below.

FIG. 2 also illustrates mechanisms by which the angular relationship of the camshafts with respect to the crankshaft can be controlled. Crankshaft 42 carries timing gear 76 fixed thereto and rotating therewith. Camshafts 52 and 56 carry timing gears 92 and 94 fixed thereon. Conventionally, timing gears 92 and 94 have twice the number of teeth thereon as timing gear 76 so that camshafts 52 and 56 rotate at half the speed of crankshaft 42. The timing gears conventionally carry teeth, which are engaged by timing belt or chain 54. A chain is conventionally of flexible metallic structure and has tooth engagement surfaces thereon so that positive engagement can be achieved with the timing gears. A timing belt is a similar structure, but is usually a composite of cord, cable, cloth and rubberlike materials. Such a belt has engagement surfaces along its length for providing a timing function and can be well-described as a timing chain. Such timing chains conventionally have one idler roller thereagainst to take up slack.

In the internal combustion engine of this invention, the timing chain is provided with two tension control and guide rollers 78 and 80. Guide roller 78 is mounted on slide rod 82 which has a slot therein by which the slide rod engages over two pins mounted in the fixed structure of the engine to control the sliding direction. Motor 84 is connected to slide rod 82 to move it to control the position of guide roller 78. Its position controls the amount of loop of chain 54 on the left side between the two timing gears 76 and 92. Similarly, guide roller 80 is mounted on slide rod 86 which is also controlled for linear sliding over two pins. Compression springs interengage between the two slide rods to resiliently urge center slide rod 88 to continuously maintain timing chain 54 in an adequately tightened condition. The use of slide rods to movably mount the idler rollers is illustrative. They could just as well be mounted on pivoted swinging arms. An input signal to controller 90 drives motor 84 to position slide 82 and guide roller 78.

When controller 90 actuates motor 84 to move chain guide 78 downward, such causes a larger loop of chain between timing gear 76 on the crankshaft and the timing gear 92 on camshaft 52. This rotates cam 50 counterclockwise with respect to the crankshaft. Similarly, downward motion of guide 80, driven by its control and motor, causes a larger loop between timing gear 76 and timing gear 94 on camshaft 56. This rotates camshaft 56 in the clockwise direction with respect to the crankshaft. Spring-loaded guide roller 96 manages the slack. In this way, the cams 50 and 58, respectively controlling the intake and exhaust valves 44 and 46 may be advanced and retarded with respect to the angular position of the engine as defined by the crankshaft position.

FIG. 4 illustrates timing diagram 136 which shows one crank revolution or two strokes of a four-stroke cycle internal combustion engine. Point 138 illustrates the point at which the intake valve opens at top dead center at the beginning of the intake stroke. At slow engine speed, the intake valve closes at point 140, at bottom dead center. However, at a high engine speed, the intake valve should close later, at point 142 to aid in engine breathing. After point 142 is the compression stroke and, thereafter, the hot gas expansion stroke. In order to exhaust the hot gases at high rpm, the exhaust valve should open at point 144, before bottom dead center. However, at low engine rpm, the exhaust stroke should open at point 146 which is at bottom dead center. The exhaust valve stays open to point 148 which is at top dead center. It can be appreciated that the valve control system illustrated in FIG. 2 can achieve these desirable results.

The structure in FIG. 3 is similar to that in FIG. 2. It has the camshafts 72 and 64 with both their cams 74 and 66 acting on rocker arm 192. The camshafts 72 and 64 in FIG. 3 are controlled the same way they are in FIG. 2. However, the rocker arm 192 controls slide valve 194 instead of a poppet valve. Slide valves are often used in other types of engines such as steam and compressed air engines. The valve control mechanism of this invention is suitable for controlling valve motion in other types of engines than four-stroke cycle internal combustion engines.

When two cams are used to open the same valve, one cam can be advanced in phase with respect to the other cam so that the valve will open earlier due to the effect of the cam more advanced in phase. The cam not advanced in phase will not allow the valve to close any earlier so that the valve open duration can be decreased. If one cam is retarded in phase with respect to the other cam, the valve is not allowed to close as early, but the non-retarded cam would still open the valve at the same point, so valve open duration could also be increased. By advancing or retarding either or both of the cams, both the valve open duration can be controlled, and also the specific point in the timing cycle to open or close a valve can be controlled. In general when the cams are moved out of phase, valve opening duration is increased, and when the cams are moved closer to identical timing phases, valve open duration is decreased.

The valve control system 170, illustrated in two positions in FIGS. 5 and 6, is also suitable for use in controlling the valves in a four-stroke cycle internal combustion engine, or other type of engine. The structure is shown in some more detail in FIG. 7. Camshaft 172 is the same as camshaft 52 and is driven by the timing chain drive system of FIG. 2. Camshaft 172 carries cam 174 which acts against rocker arm 176. Rocker arm 176 is pivoted on rocker arm pivot shaft 178. Valve 180 is illustrated as a spring-closed poppet valve which is moved off of its seat by rotation of rocker arm 176 caused by rising of the cam lobe. While poppet valve 180 is illustrated, it is clear that another type of valve can be actuated.

Rocker arm pivot shaft 178 can be adjusted along a line 182. FIG. 5 illustrates the right-hand terminal position of the rocker arm along the line 182, while FIG. 6 illustrates the left-hand terminal position. In these figures, the rocker arm is in direct contact with the cam lobe and valve stem. In other mechanisms, intermediate structures such as hydraulic lifters and rods serve as extensions between the structures so that the effective point of contact with the rocker arm is away from the actual cam lobe or valve stem.

Line 182 is preferably parallel to a line connecting the arc of rotation of the cam lob at its highest point and the point where the rocker arm impinges to open the valve at the valve's greatest lift open position. When line 182 falls along this path, the maximum amount of valve lift opening would remain constant while pivot point 178 is moved in either direction along this line to increase or decrease valve open time. If line 182 is inclined more towards the cam, then valve lift opening would increase as point 178 moved closer to the cam. If line 182 is inclined more away from the cam, valve lift opening would be increased when point 178 moved away from the cam. Of course, the geometry is arranged so that when the cam lobe is rotated away, the valve fully closes. Ordinarily, it is expected that a relatively uniform valve lift opening would be desired while rotational opening was modified at different engine rotational speeds. If it is desired to modify valve lift, however, it is possible to incline line 182 to achieve the desired effect, and a curved path might be desirable under some circumstances to control the change in amount of lift and valve opening duration at various engine speeds.

In the position of FIG. 5, it can be seen that the valve 80 is open through the angle Theta 1, while in FIG. 6, the valve is open through the angle Theta 2. Thus, by adjusting the position of pivot shaft 178, the effective valve open duration can be controlled. Furthermore, by controlling the position and angle of line 182, the effective opening or closing time of the valve can be controlled. The position of pivot shaft 178 is controlled by screws 184, 186, 188 and 190. These adjustment screws are controlled in accordance with the engine speed to correctly control the valves for maximum efficiency and minimum pollution. When intermediate structures are used in the valve train, the path of rocker arm axis movement which would provide uniform valve lift opening while duration of opening was changed would be dependent upon the geometry of the intermediate structure connecting parts.

FIG. 2 illustrates adjustment screws 98 and 100 which respectively adjust the pivot pins 102 and 104 of rocker arms 48 and 62. This adjustment is along the line 180 to define with respect to FIGS. 5, 6 and 7 and accomplishes the adjustment described therein.

FIG. 2 also shows two features of push rod adjustment for adjusting the valve timing and valve open duration. The first is the adjustment of push rod length. Camshaft 56 carries thereon a cam having lobe 58. Cam lifter 106 engages against the cam and actuates push rod 108. Wedge 110 is fully inserted into the push rod to maximize push rod length. The push rod acts against rocker arm 62 which causes opening of valve 46. Valve 46 is urged toward its closed position by means of a valve spring and may be either the intake or the exhaust valve of the engine on which the control is installed. By means of this mechanism, the valve 46 is off of its seat through a portion of the camshaft rotation. When wedge 110 is partly withdrawn from push rod 108, it shortens the overall length of push rod 108. This means that cam lobe 58 must lift the push rod a short distance before it is effective in opening the valve. Thus, the valve is off of its seat through a camshaft angle which is smaller. In addition, the beginning of cam opening is delayed and the cam closing is advanced by this mechanism. Lifter 106 is provided to take the slack out of the system, when push rod 108 is less than its maximum length, to prevent clattering and wear. The system thus provides for reducing the valve open duration by opening later and closing earlier. Push rod guide control lever 112 can move the impact point of the push rod closer to the pivot point of the rocker arm so that as the push rod is made shorter by the wedge, the amount of valve lift can be maintained at the desired level by causing a shorter amount of push rod movement to cause whatever movement of the rocker arm is desired. This action is described in more detail below.

The valve controller shown in FIG. 2 also accomplishes control of valve open duration in connection with valve opening and closing timing, while maintaining the full valve opening. The left end of rocker arm 62 is cam lever 114, which in the direction away from the rocker arm pivot has its lower surface angled downwardly toward camshaft 56. Push rod 108 extends upwardly into a slot in cam lever 144. Crosspin 116 carries a roller 118 which engages under cam lever 114. When the push rod is in its leftmost position shown in FIG. 2, the roller 118 engages against the bottom of the cam lever 114 when the lobe 58 is farthest away from lifter 106. In this condition, when the lobe first reaches the lifter, the mechanism starts moving for an early opening of valve 46, and, when the lobe leaves the lifter, provides a late closing of the valve. Under these conditions, roller 118 engages under cam lever 116 at radius R1 for maximum valve opening.

When a later valve opening, an earlier valve closing and a shorter valve open duration are desired, control lever 112 moves push rod 108 to the right position. At this position, the roller 118 is at the radius R2 and is away from the bottom of cam lever 114 by the distance labeled "delay". When cam lobe 58 reaches lifter 106, it must raise the push rod the intial amount "delay" before the valve starts opening. Further actuation by the cam lobe lifts the push rod to open the valve. The shorter lever arm R2 from the rocker arm pivot point to the roller 118 is such as to cause full opening of the valve 46 when the cam lobe is at its maximum lift posiion. As the cam lobe lowers the push rod, roller 118 permits the rocker arm to rock back and the valve to close, with the closing occurring before the cam lobe 58 has completely lowered lifter 106, by the amount of the "delay". Thus, the valve closes earlier. Control lever 112 is actuated by any convenient motor in response to signals for control of valve opening and closing timing and valve opened duration.

In review, the effective length of the push rod can be controlled both by the angle with which lever 114 meets the push rod 108, by the amount of insertion of lever 115, and also by the angle of screw 100 when multiple adjustments are made. Any of three adjustments could be made individually or in any combination. As effective length of the push rod becomes shorter, valve opening duration is decreased, while the actual amount of valve lift may be kept constant by shortening the leverage distance btween contact roller 116 and the rocker arm lever shaft 104. The contact point can be adjusted by pivoting the push rod, or by moving the rocker arm pivot shaft 104, or both. In the most usual case of operation it is expected that at very low rotational speeds the intake valve would open at the beginning of the intake stroke and close at the end of the intake stroke. At high speeds the valve open duration would be increased and the intake cam rotational phase retarded so that the valve would still open at the beginning of the stroke, but would not close for a desired rotational period after the intake stroke had actually been completed. The exhaust valve at low rotational speeds would open at the beginning of the stroke and would close at the end of the stroke. At high rotational speeds the valve open duration would be increased and the cam rotational phase would be advanced so that the exhaust valve would stil close at the bottom of the stroke, but would begin to open prior to the beginning of the exhaust stroke.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A valve control mechanism for an engine having a valve for controlling fluid flow with respect to a cylinder and a rotating cam driven by the engine, said cam having a lobe having rising and falling cam faces thereon, a cam follower in contact with said cam faces for actuation by said cam faces, a rocker arm pivoted on an axis to act with respect to said valve to open said valve, a push rod, said push rod being actuated by said cam follower and acting against said rocker arm, the improvement comprising:

movable means connected to said push rod for moving said push rod with respect to said rocker arm so that said push rod acts at a selected radius on said rocker arm for selecting a desired valve opening distance; and adjustable means for adjusting the total effective length between the contact point of said cam follower with respect to said cam faces and the contact point of said push rod with respect to said rocker arm, said movable means and said adjustable means acting together so that when adjustable means shortens said push rod so that it is acted on later by said rising cam face and released earlier by said falling cam face to provide less effective cam lift, said movable means moves said push rod to a shorter selected radius so as to maintain a constant valve opening distance with later actuation of said push rod by said rising cam face.

2. The valve control mechanism of claim 1 wherein said pivot axis of said rocker arm is positioned between the effective point of contact of said push rod with said rocker arm and the effective point of contact of said valve with said rocker arm.

3. The valve control mechanism of claim 1 wherein said line along which said pivot axis is movable is substantially parallel to a line between the effective point of contact of said push rod with said rocker arm at its highest lift point and the effective point of contact of said rocker arm with said valve at the maximum valve open position.

4. The valve control mechanism of claim 1 wherein the line along which said rocker arm pivot axis is movable is a straight line.

5. The valve control mechanism of claim 1 wherein the shape of the rocker arm is such that collection of all possible points of force of the push rod against the rocker arm when the valve is in the completely open position would follow an arc such that the maximum amount of valve opening would be constant regardless of the change in the amount of valve opening rotational duration.

6. The valve control mechanism of claim 1 wherein more than one camshaft is used, and the camshaft used to control the intake valves is different than the camshaft used to control the exhaust valves.

7. The valve control mechanism of claim 6 wherein the phase of the camshaft controlling intake valves is altered from the rotational phase of the camshaft controlling the opening of the exhaust valves.

8. The valve control mechanism of claim 7 wherein the phase changes of the camshafts controlling the opening of the intake and exhaust valves are caused by changing the position of idler gears used to position a timing chain used to drive the camshafts.

9. The valve control mechanism of claim 6 wherein the phase of the camshaft controlling exhaust valves is advanced with respect to the phase of the intake valve when the valve rotational opening duration is increased.

10. A valve control mechanism for an engine having a valve for controlling fluid flow with respect to a cylinder and a rotating cam driven by the engine, said cam having a lobe having rising and falling cam faces thereon, a rocker arm acting against said valve to open said valve a selected amount, the improvements comprising:

a push rod, said push rod acting against said rocker arm so that said push rod is moved by said cam and opens said valve, said push rod being adjustable in stroke so that at a first position said push rod causes valve opening when said push rod is actuated by early slopes of said cam lobe and permits valve closing late on the slopes of said cam lobe and when in a second position causes valve opening late on the slopes of said cam lobe and permits valve closing early on the slopes of said cam lobe so as to control valve timing and valve open duration; and means for controlling said push rod to maintain the selected amount of valve opening.

11. The controller of claim 10 wherein said push rod is adjustable by having a fixed length push rod, and positioning the point of contact with the push rod with the rocker arm, so that by the geometrical shape of the rocker arm, the push rod when contacting that point pushes that point a maximum distance after the valve first starts to open which is different than the maximum distance the push rod would push a second point on the rocker arm after the valve first started to open, when the push rod contacted the rocker arm at said second point, the point of contact with the push rod against the rocker arm may involve other parts such as rollers, guides, or adjusters.

12. The controller of claim 10 wherein said push rod is made physically longer or shorter so that the point of force of the push rod with the rocker arm is pushed a different maximum distance after the valve first starts to open, when the length of the push rod is changed, the point of contact of the push rod against the rocker arm normally being where the point of force occurs, but there may be other intermediary parts such as adjusters which would not change the effective point of contact.

13. The controller of claim 11 wherein the radial distance between the push rod point of contact with the rocker arm and the pivot axis of the rocker arm is modified to allow a relatively constant amount of maximum valve opening.

14. The controller of claim 12 wherein the radial distance between the push rod point of contact with the rocker arm and the pivot axis of the rocker arm is modified to allow a relatively constant amount of maximum valve opening.

15. The controller of claim 10 wherein there is a rocker arm engaged by said push rod and engaging said cam, said push rod being adjustable by being movable with respect to said rocker arm so that the point of lift on the rocker arm by the push rod changes.

16. The controller of claim 10 wherein the amount of rocker arm movement controlling the valve opening is controlled both by changing the push rod length and changing the point of effective contact of the push rod with the rocker arm.

17. The controller of claim 10 wherein said push rod engages said rocker arm on a surface, either directly or though intermediary devices, and adjustment of said push rod causes said rocker arm to engage on different portions of said surface to change both the angular position of said cam at which said cam causes valve opening and changes the radial distance between the point of contact of the push rod and the rocker arm and the rocker arms pivot point, of said rocker arm.

18. The controller of claim 17 wherein the radial distance between the point of engagement of the push rod and the rocker arm and the pivot point of said rocker arm, is changed to maintain a substantially constant amount of opening of said valve at different push rod adjustments of valve open duration and timing.

19. The valve control mechanism of claim 10 wherein said push rod engages said rocker arm on a surface, and adjustment of said push rod causes said rocker arm to engage on different portions of said surface to change both the angular position of said cam at which said cam causes valve opening and changes the radial distance between the point of contact of the push rod and the rocker arm and the rocker arms pivot point, of said rocker arm.

20. The valve control mechanism of claim 19 wherein more than one camshaft is used, and the camshaft used to control the intake valves is different than the camshaft used to control the exhaust valves, and wherein the phase of the camshaft controlling intake valves is altered from the rotational phase of the camshaft controlling the opening of the exhaust valves.

21. The valve control mechanism of claim 20 wherein the phase changes of the camshafts controlling the opening of the intake and exhaust valves are caused by changing the position of idler gears used to position a timing chain used to drive the camshafts.

22. The valve control mechanism of claim 10 wherein means is provided to move said rocker arm such that the pivot point is moved such that said push rod engages said rocker arm on a surface, either directly or through intermediary devices, and adjustment of said rocker arm causes said rocker arm to engage on different portions of said surface to change both the angular position of said cam at which said cam causes valve opening and changes the radial distance between the point of contact of the push rod and the rocker arm and the rocker arms pivot point, of said rocker arm.

23. The valve control mechanism of claim 22 wherien more than one camshaft is used, and the camshaft used to control the intake valves is different than the camshaft used to control the exhaust valves, and wherein the phase of the camshaft controlling intake valves is altered from the rotational phase of the camshaft controlling the opening of the exhaust valves.

24. The valve control mechanism of claim 23 wherein the phase changes of the camshafts controlling the opening of the intake and exhaust valves are caused by changing the position of idler gears used to position a timing chain used to drive the camshafts.

25. A valve actuating mechanism for controlling valve opening comprising in combination:

a valve, a pivotable rocker arm in contact with said valve, a cam having a lobe and a push rod acting between said cam lobe and said rocker arm to open said valve, and means for changing the stroke of said push rod while simultaneously changing the radial point of force of the push rod against the rocker arm, so that the point of initial opening or final closing of the valve is changed with respect to the rotation of the cam lobe.

26. The valve actuating mechanism of claim 25 wherein the effective length of the push rod is changed by having a rocker arm with a geometric shape so that when the radial point of contact with the rocker arm changes, the distance from the cam lobe to the lift point on the rocker arm is changed, which is an effective length change of the push rod.

27. The valve actuating mechanism of claim 25 wherein the effective length of the push rod is accomplished by changing the physical length of the push rod.

28. The valve actuating mechanism of claim 25 wherein the effective length of the push rod is accomplished partially by the geometric shape of the rocker arm and partly by the actual change in physical length of the push rod.

29. The valve actuating mechanism of claim 25 wherein said push rod pivots on one end which is not in contact with said rocker arm, and on the other contacts said rocker arm, said rocker arm having a geometrical shape such that when the end of said push rod contacting said rocker arm is closer to the rocker arm pivot, the cam lobe does not cause said push rod to cause said rocker arm to open said valve until said cam has completed a greater rotational movement and the end of said push rod contacting said rocker arm is at a lesser distance from the rocker arm pivot to maintain substantially constant valve opening.

30. The valve actuating mechanism of claim 25 wherein there is a cam follower in contact with said cam and said push rod pivots on the end in contact with said cam follower, and the other end of said push rod contacts said rocker arm, said rocker arm having a geometrical shape such that when the end of said push rod contacting said rocker arm is closer to the rocker arm pivot, the amount of distance from the center of the cam shaft to the bottom of the followers which contacts the cam lobe when the cam lobe first causes the lifter to move the push rod to rock the rocker arm to open the valve, is greater than the same distance when the contact point between the end of said push rod and said rocker arm is at a greater distance from said rocker arm pivot point.

31. The valve actuating mechanism of claim 25 wherein there is a cam follower in contact with said cam and said push rod pivots on the end in contact with said cam follower, and the other end contacts said rocker arm, said push rod being shortened in length when the end of the push rod contacting the rocker arm is closer to the rocker arm pivot, and the shorter push rod length causes the amount of distance from the center of the camshaft to the bottom of the follower which contacts the cam lobe when the cam lobe first causes the follower to force the push rod to force the rocker arm to open the valve to be greater than the same distance when the contact point between the end of the push rod and the rocker arm is at a greater distance from said rocker arm pivot point, and the length of the push rod is greater.

32. The valve actuating mechanism of claim 30 wherein said push rod remains at a constant length.

33. A valve control mechanism for an engine having a valve for controlling fluid flow with respect to a cylinder with a piston in the cylinder and a crankshaft controlling the piston in the cylinder together with a timing gear rotating in synchronism with said crankshaft, the improvement comprising:

first and second camshafts, said first camshaft carrying at least one lobe thereon for control of the intake valves of said engine and said second camshaft having at least one lobe thereon controlling the exhaust valve of said engine, first and second timing gears fixed to said first and second camshafts, a timing chain extending around said timing gear rotating in synchronism with said crankshaft and said first and second timing gears on said first and second crankshafts, first and second idler gears respectively engaging said timing chain between said synchronous timing gear and said first and second timing gear so that positioning of said first and second idlers adjust the angles of said first and second camshafts with respect to said crankshaft;

first and second rocker arms respectively positioned to actuate said intake and said exhaust valves and first and second push rods respectively connected to be actuated by said first and second cams and to actuate said first and second rocker arms;

means connected to each of said first and second push rods for independently adjusting the stroke of said first and second push rods to adjust the point at which said push rods actuate the respective rocker arms; and means connected to each of said first and second push rods for respectively adjusting the point of contact of said first and second push rods with said first and second rocker arms so that the angular stroke of said first and second rocker arms can be controlled to maintain substantially constant valve opening so that adjustment of said idler rollers, said push rod length adjusting means and said push rod contact point adjusting means can selectively control the valve open duration and valve opening and closing timing of both said intake and said exhaust valves without substantially changing valve opening distance.

34. The valve control mechanism of claim 33 wherein the pivot point of each of said rocker arms is adjustable to control the length of the lever arms of said rocker arm to the push rod contact point and the valve contact point thereon.

35. The device in claim 34 wherein the rocker arm pivot point is moved in a linear path.

* * * * *